United States Patent [19]

Sekiguchi et al.

[11] 4,288,393

[45] Sep. 8, 1981

[54] DIRECT CONTACT CONDENSER

[75] Inventors: Hideki Sekiguchi; Michizo Miyoshi; Katsutoshi Yonemura, all of Yokohama, Japan

[73] Assignee: Tokyo Shibaura Denki Kabushiki Kaisha, Japan

[21] Appl. No.: 149,565

[22] Filed: May 14, 1980

[30] Foreign Application Priority Data

Jun. 30, 1979 [JP] Japan ..... 54-82817

[51] Int. Cl.[3] ..... B01F 3/04

[52] U.S. Cl. ..... 261/108; 122/487; 165/116; 261/113; 261/114 R; 261/118; 261/DIG. 10; 261/DIG. 44

[58] Field of Search ..... 261/108, 113, 118, DIG. 10, 261/DIG. 32, DIG. 44, 114 R; 122/487; 165/112, 115, 116

[56] References Cited

U.S. PATENT DOCUMENTS

| | | | |
|---|---|---|---|
| 899,063 | 9/1908 | Mueller | 261/113 |
| 1,855,231 | 4/1932 | Grace | 165/112 X |
| 2,558,222 | 6/1951 | Parkinson | 261/113 |
| 2,956,784 | 10/1960 | Parkinson | 261/113 X |
| 3,363,678 | 1/1968 | Forster et al. | 165/112 |
| 3,575,392 | 4/1971 | Stoker et al. | 261/113 |

FOREIGN PATENT DOCUMENTS

| | | | |
|---|---|---|---|
| 54-3203 | 2/1979 | Japan | 261/DIG. 10 |

*Primary Examiner*—Richard L. Chiesa

*Attorney, Agent, or Firm*—Finnegan, Henderson, Farabow, Garrett & Dunner

[57] ABSTRACT

A direct contact condenser is arranged to establish sequential steam flows of downward, lateral, and tortuous but collectively upward directions in a housing. Cooling liquid fed to the condenser is introduced to first overflow means for temporarily accumulating cooling liquid and for allowing excess accumulated cooling liquid to overflow. Second overflow means is provided for temporarily accumulating the cooling liquid supplied from the first overflow means, for allowing the cooling liquid to fall in multiple streams into the collectively upward steam flow zone to cause direct heat exchange between the falling cooling liquid and the steam, and for causing excess cooling water accumulated by the second overflow means to overflow. The cooling liquid overflowing from the second overflow means is supplied to the downward stream flow to cause direct heat exchange between the cooling liquid and the steam when excess accumulated cooling liquid overflows from the second overflow means.

5 Claims, 5 Drawing Figures

Fig. 3
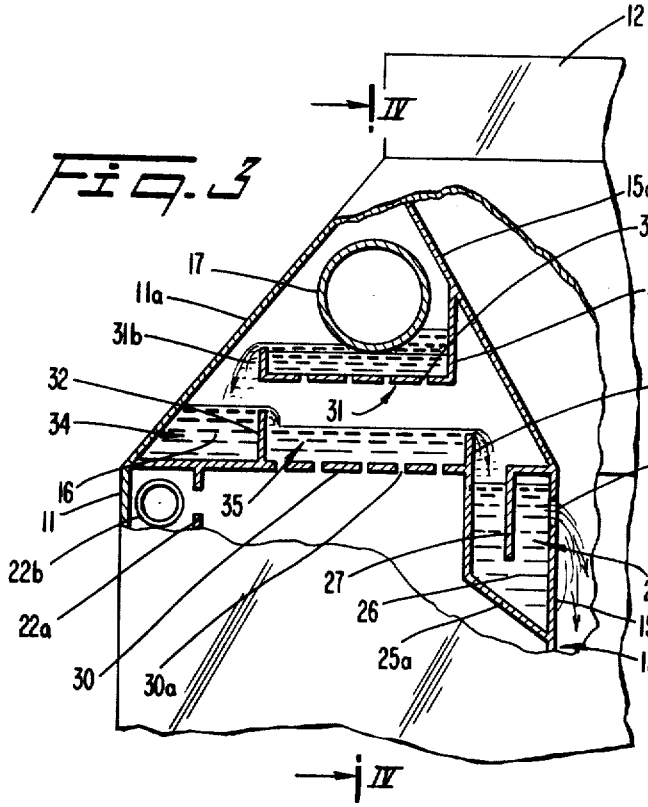
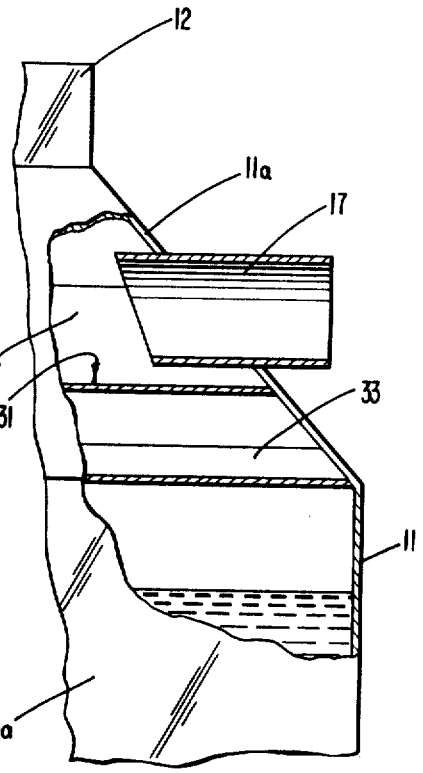
Fig. 4
Fig. 5
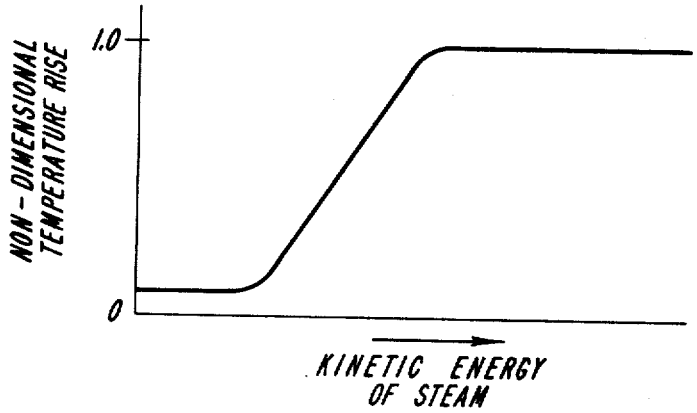

DIRECT CONTACT CONDENSER

BACKGROUND OF THE INVENTION

This invention relates to direct contact condensers for use with steam turbines to condense steam drained from such turbines by direct heat exchange between the steam and the liquid coolant.

Generally, direct contact condensers are used very often for steam turbine plants, such as, for example, electric power plants, which are located in areas wherein it is difficult to obtain sufficient cooling water. Direct contact condensers are also used in geothermal power plants in which there is no need to recycle the steam condensate to steam generators. Because the direct heat exchange provides relatively high efficiency in the utilization of the cooling water, it is particularly useful in these aforesaid applications.

In prior art direct contact condensers, steam drained from a turbine enters at the top portion of a horizontally elongated housing and flows downwardly over the full longitudinal length at the widthwise-middle portion of the housing. A baffle member is used to divide and change the direction of this downward flow in generally lateral opposite directions toward the widthwise-end walls of the housing. These lateral flows again generally change direction and travel collectively upwardly over the full longitudinal length of the housing at both widthwise side portions.

These collectively upward flows are made to travel a tortuous path. Streams of cooling water fall in these upward flow zones to cause direct heat exchange. Condensate drops down, is temporarily accumulated in the bottom of the housing, and is then drained along with the cooling water. The noncondensable gases are exhausted from the top portions of the upward flow zones. Such direct contact condensers are disclosed in U.S. Pat. No. 3,575,392.

Improvements have been made to reduce the size of such prior art condensers. These improvements depend on the fact that the downward steam flow, immediately following the entrance, has a relatively high speed such as, for example, 100 meters per second. If cooling water is supplied to such high speed steam flow, the water is converted to a mist which provides good direct contact heat exchange. Accordingly, devices for supplying water to the downward steam flow have been devised.

In this connection, when the load on the steam turbine is reduced, the amount of drained steam therefrom is also reduced. It is necessary in devices having water injection in the downflow stage to stop supplying water to this stage is periods of reduced steam flow, because the kinetic energy of the steam in the upward steam flow stage is reduced due to condensation in the downward flow stage to the point where insufficient kinetic energy is available to obtain good heat exchange efficiency in the collective upward flow stage. Although this problem has been also taken in consideration in the prior art devices, operation of such devices has not been stable, as set forth hereinafter. Such prior art devices are disclosed in Japanese Utility Model Publication No. 3203/79.

SUMMARY OF THE INVENTION

Accordingly, an object of this invention is to improve liquid coolant supplying devices for downward steam flow stage of a direct contact steam condenser to provide automatic and stable water coolant feed-stop operation.

According to this invention, a direct contact condenser is provided which comprises a horizontally elongated housing; partition means extending longitudinally within the housing and also extending from a top portion toward a middle portion of the housing for defining a steam inlet means in the top of the housing, downward passage means, lateral passage means, and collectively upward passage means, for establishing the sequential steam flows within the housing; first overflow means extending longitudinally within the housing at its top portion above collectively upward passage means for temporarily accumulating cooling liquid fed to the condenser and for allowing excess accumulated cooling liquid to overflow; second overflow means extending longitudinally within the housing under the first overflow means and above the collectively upward passage means for temporarily accumulating the cooling liquid supplied from the first overflow means, for allowing the cooling liquid to fall in multiple streams into the collectively upward passage means to cause direct heat exchange between the falling cooling liquid and the steam, and for causing excess cooling water accumulated by the second overflow means to overflow; means for supplying the cooling liquid overflowing from the second overflow means to the downward passage means to cause direct heat exchange between the cooling liquid and the steam in the downward passage means when excess accumulated cooling liquid overflows from the second overflow means.

BRIEF DESCRIPTION OF THE DRAWINGS

FIG. 3 shows a schematic cross-sectional view of the improved portion of the direct contact condenser according to this invention;

FIG. 4 shows a schematic cross-sectional view, taken along the line IV—IV, of the direct contact condenser shown in FIG. 3;

and

FIG. 5 shows a plot illustrating the relationship between the kinetic energy of the steam and non-dimensional temperature rise of the cooling water.

DETAILED DESCRIPTION OF THE PREFERRED EMBODIMENT

Figure 1:
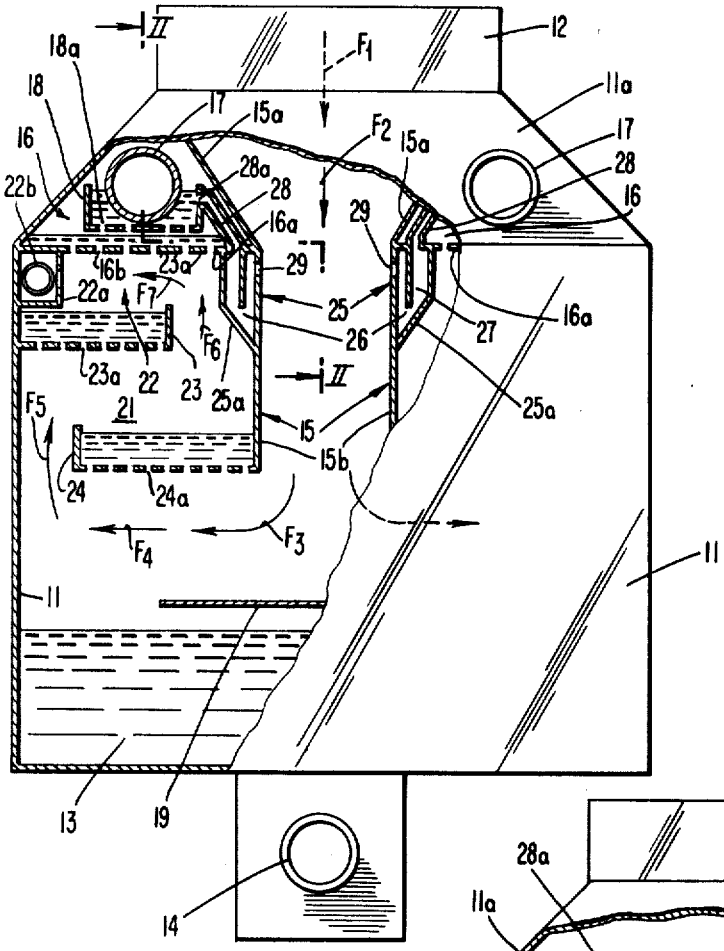
Fig. 1 PRIOR ART
FIG. 1 shows a schematic elevational view, partly in cross-section, of a prior art direct contact condenser.
Figure 2:
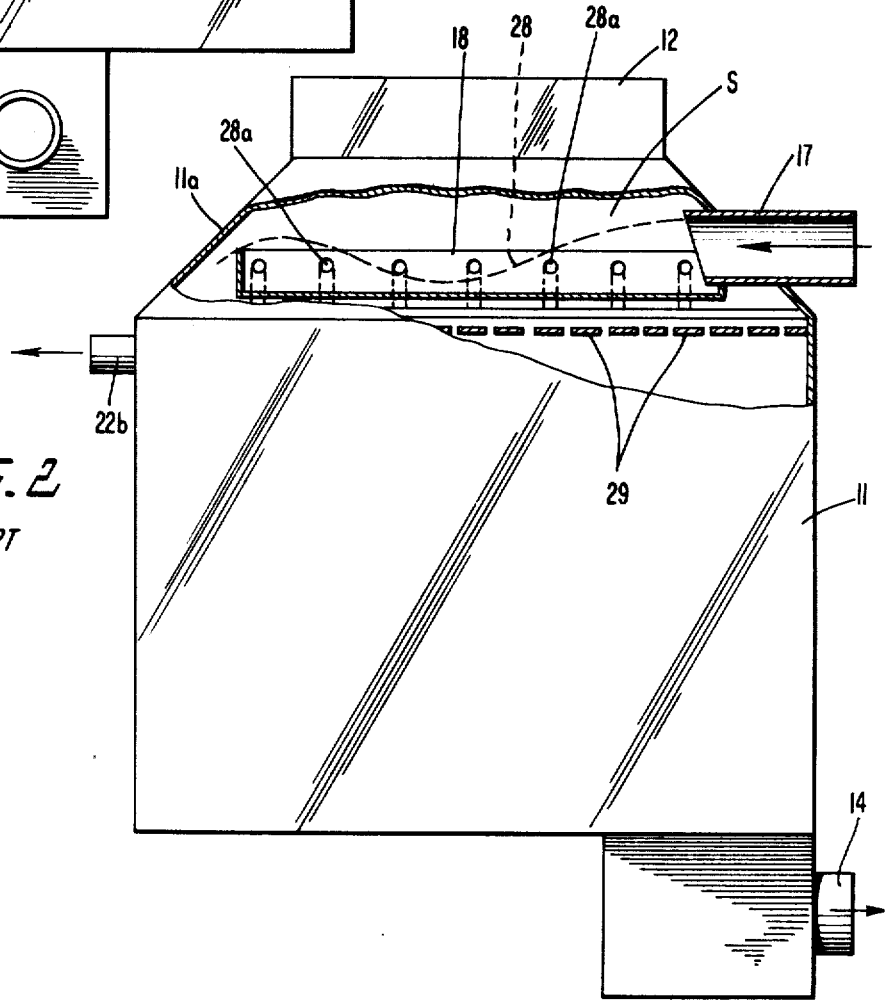
Fig. 2 PRIOR ART
FIG. 2 shows a schematic side view, partly in cross-section taken along the line II—II, of the prior art direct contact condenser of FIG. 1.

Referring to FIGS. 1 and 2, the prior art direct contact condenser, as referred to hereinabove, comprises a horizontally elongated housing 11 with slant portion 11*a* on which a steam inlet duct 12 defining steam flow $F_1$ is mounted. A bottom portion of housing 11 forms a tank 13 to accumulate condensate which is drained through a condensate outlet 14 provided beneath tank portion 13. There are provided a pair of partition wall members 15 extending the full longitudinal length of housing 11 and also extending from the respective lower ends of longitudinal side portions of steam inlet duct 12 to the middle portion of housing 11. Partition members 15 have upper skewed portions 15*a* which are oriented to approach one another and to extend to respective lower vertical portions 15*b*, which lower portions are arranged in parallel planes, thus defining a downward steam flow passage for steam flow $F_2$.

Spaces, of triangular cross-sectional shape, defined by slant portions 11*a* and skew portions 15*a* of partition member 15 are parted by horizontal plate members 16*a* extending the full longitudinal length of housing 11 to form liquid coolant chambers 16. Liquid coolant, such as water, is introduced to chambers 16 through respective tube-like water inlets 17 which are provided at one longitudinal end of housing 11 and open into the housing 11 near such end. A pair of buffer trays 18 each with a longitudinal length slightly shorter than that of housing 11 are positioned with spaces between buffer trays 18 and plate members 16*a* to allow water fed through inlets 17 to temporarily accumulate in the trays 18 and to overflow to the bottom of chambers 16. The bottom plates of buffer trays 18 have apertures 18*a* to allow water to pass therethrough and to fall on bottom members 16*a* of chambers 16. Buffer trays 18 function to reduce the kinetic energy of water fed through inlets 17 and to supply water to the bottom portions of chambers 16 relatively uniformly.

Bottom plate members 16*a* of chambers 16 have apertures 16*b* to allow water to pass therethrough and to fall along the full length of housing 11. A pair of trays 23 each extending the full length of housing 11 also extend laterally inwardly from the respective widthwise vertical end walls of housing 11 to form upward steam flow passages defining steam flow $F_6$ with the respective lower portions 15*b* of partition member 15 and to receive water streams exiting chamber 16 through aperture 16*b*. The trays 23 include apertures 23*a* at their bottom portions for forming water droplets which fall from trays 23. A pair of other trays 24 of full length of housing 11 extend laterally outwardly from the lowermost ends of respective bottom partition members 15*b* to form steam flow passages defining steam flow $F_5$ and to receive water droplets falling from trays 23. Trays 24 comprise also apertures 24*a* for allowing water droplets to fall therefrom. A horizontal baffle plate member 19 extending in full length of housing 11 is provided to change the direction of downward steam flow $F_2$ to lateral outward flows $F_3$ and $F_4$ as indicated in FIG. 1. The lateral outward steam flows then turn upward in flows $F_5$ to pass through spaces between widthwise walls of housing 11 and trays 24. The steam then flows laterally in spaces between stays 24 and 23 and then upward in flow $F_6$ between tray 23 and wall 25*a*. The steam then flows laterally in the spaces between trays 23 and bottom plates 16*a* (flow $F_7$). Thus generally lateral and upward passages 20 are formed, including tortuous passages 21 and 22. Hence, the prior art condenser shown in FIGS. 1 and 2 defines a series of sequential, directed steam flows $F_1$–$F_7$ through housing 11. Noncondensable gases are exhausted through ducts 22*a* and gas outlets 22*b* at the end of passages 22.

Wall members 25*a*, generally L-shaped in cross-section, are secured to bottom plate members 16*a* and vertical portions 15*b* of partition members 15 to form chambers 25 along the corners of members 16*a* and portions 15*b* over their full length. Provided within elongated chamber 25 are longitudinal walls 27 extending vertically from the bottom plate members 16*a* dividing chamber 25 into inwardly and outwardly positioned sub-chambers, relative to partition member 15, and forming submerged orifices 26 at the bottom of elongated chambers 25 connecting the respective inward and outward subchambers. Widthwise outward subchambers of elongated chambers 25 are communicated with the respective ones of buffer trays 18 by plurality of conduits 28 having openings 28*a* in widthwise inner sidewall of buffer trays 18 at a predetermined height. Openings 29 for supplying water to the downward passage $F_2$ are provided at vertical portion 15*b* of partition member 15 to communicate with the upper portions of the respective inward subchambers of elongated chambers 25.

In operation, excess water introduced to buffer trays 18 and not falling through apertures 18*a* into chamber 16 accumulates in trays 18 and then overflows. The water from apertures 18*a* accumulates in the bottom of water chambers 16 and thereafter falls through apertures 16*b* of bottom plate 16*a* into trays 23. Water in trays 23 falls through apertures 23*a* to trays 24, and water in trays 24 similarly falls to tank 13. Thus, sprays of water droplets exit in steam passages 20, 21 and 22. Accordingly, steam flowing through these passages, as indicated by arrows $F_3$–$F_7$, with relatively high speed is condensed by direct heat exchange with sprays of water.

On the other hand, water accumulating in buffer trays 18 also flows to elongated chamber 25 if the water level is high enough to reach openings 28*a*, and then flows through openings 29 in partition member 15 to downward steam flow passage due mainly to difference of water heads therebetween. Downward steam flow $F_2$ has sufficiently high speed to change water fed through openings 29 to a mist state. Accordingly, some of the steam flow $F_2$ is condensed by direct heat exchange with the water from openings 29. Approximately two-fifths of total condensable steam flow in the condenser typically is condensed in this stage. Remaining steam flows along passages 20, 21 and 22 as it is condensed therein, as already explained. Noncondensable gases finally are exhausted through ducts 22*a* and outlets 22*b*.

The space factor of the condenser is greatly improved when the downward flow passage can be used as a heat exchange zone. However, the utilization efficiency of the water is typically reduced when the load on the turbine and, hence, the amount of steam fed to the condenser is reduced, if condensation in the downward passage is permitted to continue. Because the steam flow rate through the passages 20, 21 and 22 is greatly reduced due to co-existence of the decrease in the amount of steam fed to the condenser and of condensation in the downward steam passage, then the utilization efficiency of the water supplied to the passages 20, 21 and 22 is greatly reduced. When the steam flow rate through the passages 20, 21 and 22 is reduced below a certain value, the kinetic energy of the steam in the passages 20, 21 and 22 is insufficient to change water droplets flowing from members 16 and trays 23 and 24 to the mist state and inefficient operation results.

As shown in FIG. 5, non-dimensional temperature rise decreases abruptly as the kinetic energy of the steam is reduced over a certain range. The non-dimensional temperature rise is a ratio of temperature rise of water due to heat exchange with respect to the theoretical maximum temperature rise of water at ambient pressure. That is, the non-dimensional temperature rise is expressed by:

$$\frac{Two - Twi}{Tp - Twi}$$

where Twi is the temperature of the inlet cooling water, Two is the temperature of the outlet cooling water, and Tp is the saturation temperature of cooling water at a given pressure (i.e. a pressure within the condenser). In FIG. 5, non-dimensional temperature rise is measured along the ordinate and kinetic energy is measured along the abscissa.

As is easily understood by those skilled in the art, it is preferable to keep the kinetic energy above a certain value, otherwise the efficiency decreases. Usually, the amount of cooling water fed to the condenser is controlled in response to the amount of the steam fed to the condenser. Accordingly, in the condenser shown in FIGS. 1 and 2, the water level in buffer trays 18 is lowered as the amount of steam is reduced below a certain value, and the water flow from buffer trays 18 to conduits 28 and thence to openings 29 is expected to stop after the amount of the steam is reduced below a certain value. This means, steam fed to the condenser is expected to flow into lateral and collectively upward passages without condensation at a previous stage to keep the kinetic energy in lateral and upward passage as high as possible.

However, the cooling water in buffer trays 18 typically does not have a flat free surface, but has a wavy surface as, for example, shown at S in FIG. 2. This surface waviness is due to the fact that the water flow introduced into the buffer trays 18 has a relatively large kinetic energy. The water level in buffer trays 18 at respective portions changes rather cyclically. Accordingly, it is difficult to smoothly stop the flow of water into conduits 28 and through openings 29. Further, water supplied intermittently to the downward flow passage through openings 29 can cause unstable operation of the condenser.

Referring now to FIGS. 3 and 4 showing a part of the improved direct contact condenser according to this invention, wherein similar or identical parts are indicated by the same reference numerals, the following description will focus on the difference between the prior art apparatus and the apparatus according to the preferred embodiment of the present invention.

Water chamber 16 comprises a bottom plate member 30 having an elongated opening to communicate water chamber 16 with the top of the outward subchamber of elongated chamber 25. Member 30 has apertures 30*a* similar to plate 16*a* in FIG. 1. Overflow tray 31 is provided in the midde portion of chamber 16 along approximately its full longitudinal length so as to receive and guide water fed through inlet 17. A widthwise inner sidewall 31*a* extends to abut skewed portion 15*a* of partition member 15 preventing overflow from tray 31 in the immediate vicinity of the top opening of elongated chamber 25. Outer sidewall 31*b* of tray 31 has a suitable height to allow excess water fed through inlet 17 and not flowing through holes 31*c* in bottom portions of tray 31 to overflow to the outermost bottom portion of water chamber 16. Apertures 31*c* allow water to fall directly to the middle portion of water chamber 16. A first vertical baffle plate member 32 is provided on bottom plate 30 at the position approximately under the outer side wall 31*b* of tray 31. Baffle member 32 extends substantially along the full longitudinal length of water chamber 16 and is relatively high. A second vertical baffle plate member 33 is provided on bottom plate 30 adjacent the outer edge of longitudinal opening of elongated chamber 25. Second baffle member 33 extends also substantially along the full length of the chamber 16 but is relatively low in comparison with baffle member 32.

In operation, water fed through inlet 17 flows generally longitudinally along overflow tray 31 and tray 31 is filled with cooling water. Some of the water falls through apertures 31*c* of tray 31. The excess water flows over sidewall 31*b* and into first elongated space 34 defined by slant portion 11*a* of housing 11, bottom plate member 30 and first baffle member 32. When this first elongated space 34 is filled with water, water flows over first baffle member 32 into a second space 35, defined by bottom plates 30, and first and second baffle members 32 and 33. Excess water in the second space 35, that is, water not falling through apertures 30*a*, pours into elongated chamber 25 over baffle 33. Thus, water streams are supplied to collectively upward steam passage through apertures 30*a* of bottom plate 30 and also to downward steam passage through openings 29, thus affording the desired direct heat exchange between water droplets and steam.

The cooling water gradually loses its kinetic energy in the course of travelling from inlet 17 to the outermost space 34 over first baffle 32 into space 35, and over the second baffle plate 33 into chamber 25, due mainly to flowing over the weir-like side-wall 31*b* and baffle members 32 and 33. The cross-current mixing of the streams of water flowing through apertures 31*c* from tray 31 with water in second space 35 also functions to neutralize the kinetic energy of water in second elongated space 35. Thus, water in second space 35 displays an approximately horizontal and flat surface, and water pours into elongated chamber 25 approximately uniformly along full longitudinal length of the chamber 25. This also means, water in water chamber 16 is sprayed through apertures 30*a* relatively uniformly.

In situations where the amount of water is reduced below a certain value, the water level in second space 35 is reduced relatively uniformly so that the water feed to chamber 25 stops smoothly. In this situation, submerged orifice 26 prevents steam communication between the downward passage and water chamber 16. Intermittent feed of water to elongated chamber 25 can thus be substantially avoided whereby unstable operation is prevented.

Accordingly, heat exchange operation is performed only in lateral and collectively upward passages when the steam flow rate is reduced below a certain value, so that efficiency of the condenser in such situation is kept relatively high.

Although described above is a certain preferred embodiment, there may be many modifications and changes within the scope of the appended claims or within the spirit of this invention.

What is claimed is:

1. A direct contact condenser comprising:

a horizontally elongated housing;

partition means extending longitudinally within said housing and also extending from a top portion toward a middle portion of said housing for defining a steam inlet means in the top of said housing, downward passage means, lateral passage means, and collectively upward passage means for establishing the sequential steam flows within said housing;

first overflow means extending longitudinally within said housing at its top portion above collectively upward passage means for temporarily accumulating cooling liquid fed to said condenser and for allowing excess accumulated cooling liquid to overflow;

second overflow means extending longitudinally within said housing under said first overflow means and above said collectively upward passage means for temporarily accumulating the cooling liquid supplied from said first overflow means, for allowing the cooling liquid to fall in multiple streams into said collectively upward passage means to cause direct heat exchange between the falling cooling liquid and the steam, and for causing excess cooling water accumulated by said second overflow means to overflow;

means for supplying the cooling liquid overflowing from said second overflow means to said downward passage means to cause direct heat exchange between the cooling liquid and the steam in said downward passage means when excess accumulated cooling liquid overflows from said second overflow means.

2. A direct contact condenser according to claim 1, wherein said partition means comprises a pair of partition members to form a downward passage means at widthwise middle portion of said housing along substantially the full longitudinal length of said housing.

3. A direct contact condenser according to claim 1 or 2, wherein:

said first overflow means comprises a tray-like member with a sidewall for allowing overflow of water, said sidewall being distant from said downward passage means.

4. A direct contact condenser according to claim 1 or 2, wherein:

said second overflow means comprises at least one baffle member for temporarily accumulating and allowing overflow of liquid coolant fed from said first overflow means, said at least one baffle being positioned closer to said downward passage means that the point of overflow from said first overflow means.

5. A direct contact condenser according to claim 3, wherein:

said second overflow means comprises at least one baffle member for temporarily accumulating and allowing overflow of liquid coolant fed from said first overflow means, said at least one baffle being positioned closer to said downward passage means than the point of overflow from said first overflow means.

* * * * *